United States Patent [19]

Birkestrand

[11] 4,210,008

[45] Jul. 1, 1980

[54] MACHINE FOR PINCH ROLLING, DEBURRING AND THE LIKE

[76] Inventor: Orville J. Birkestrand, 129A Casuda Canyon Dr., Monterey Park, Calif. 91754

[21] Appl. No.: 921,345

[22] Filed: Jul. 3, 1978

[51] Int. Cl.[2] ..... B21D 19/04

[52] U.S. Cl. ..... 72/105; 72/109

[58] Field of Search ..... 72/80, 105, 106, 109, 72/111, 120, 121, 452; 82/82, 92; 74/397

[56] References Cited

U.S. PATENT DOCUMENTS

| | | | |
|---|---|---|---|
| 1,804,815 | 5/1931 | Schultis | 72/106 |
| 1,822,697 | 9/1931 | Hahnemann | 72/105 |
| 4,072,073 | 2/1978 | Birkestrand | 82/92 |
| 4,091,648 | 5/1978 | McCaslin | 72/121 |

*Primary Examiner*—Lowell A. Larson
*Attorney, Agent, or Firm*—William T. O'Neil

[57] ABSTRACT

A machine for working generally tubular materials to perform deburring, pinch rolling and similar operations. The open end of the work is inserted over an idling roller mounted on the end of a first shaft. A second roller is rotationally driven on the end of a second shaft, and eccentric means controlled by separate (including manual) means are provided for varying the lateral clearance between the rollers to compress and effect rotation of the tubular work contemporaneously. A unique spur gear reduction arrangement includes a pinion gear on the driving NEMA C-face motor shaft which engages the larger ring gear. The ring gear is ball keyed to the shaft supporting the driven roller. An additional opening in the housing and shaft support casting is obviated, the ring gear being inserted through the motor face opening and moved laterally to engage the driven shaft over the keying ball in a driven shaft lateral bore.

5 Claims, 3 Drawing Figures

MACHINE FOR PINCH ROLLING, DEBURRING AND THE LIKE

BACKGROUND OF THE INVENTION

1. Field of the Invention

The invention relates generally to machinery for working malleable materials (particularly metals), and more particularly to machinery for deburring and pinch rolling of tubular work.

2. Description of the Prior Art

The prior art includes mainly cutting tool machinery for deburring, and relatively more complex devices for pinch rolling various circumferentially applied shapes to generally tubular stock. In many forms, especially where cutting tools are involved, such machinery requires outside perimeter drive applied to the work, and that in itself, is relatively complex in that it requires variable jaw "chucking" of the work.

Cutting tools always require periodic sharpening or replacement and their performance after the tool is used for a time is relatively less effective as compared to that achieved while new. The cost for such replacements of cutting tools and for the maintenance labor involved are negative factors respecting the economics of their use.

The manner in which the invention provides an efficient and relatively inexpensive (in first cost and in subsequent costs) machine based on rolling operations without cutting tools will be evident as the description proceeds.

SUMMARY

The apparatus of the invention involves a rigid support housing having an opening covered by the face plate of a standard NEMA (National Electric Manufacturers' Association) C-face motor.

A pinion gear on the motor shaft engages a larger gear on the driver shaft, a driver roll being mounted on the other end of the driver (second) shaft, providing the appropriate speed reduction therefor. A parallel first shaft mounts an eccentric mechanism controlled by an operating lever (or other means alternatively) positions a second roll so that tubular work may be pinch rolled between the rolls as a function of the operating (lever) means setting.

For simplicity, the second shaft gear is uniquely mounted within the support housing by emplacing it through the housing opening before the motor is assembled thereto, and translating it laterally to approximate position. The second shaft is hollow, i.e., is tubular, and has an axially adjustable locking shaft therein. That locking shaft serves to hold a locking ball through a lateral hole in the hollow second shaft wall and into a corresponding indentation in the shaft bore of the second shaft gear. When the C-face motor is then affixed to the housing opening, its pinion gear engages the larger second shaft gear, thereby driving the second roll.

For strength, the first (idling) shaft is mounted with needle bearings, as is the driver shaft. Large resistance to lateral forces on these bearings is thereby provided.

It may be said to have been the general object of the invention to produce a pinch roll machine which is economically manufactured, easily and inexpensively maintained and is rugged and long-lifed.

The manner in which the object is achieved through a novel combination of elements, as well as other features, and capabilities of the device will be evident as this description proceeds.

BRIEF DESCRIPTION OF THE DRAWING

The drawing comprises three figures as follows.

DETAILED DESCRIPTION

Figure 1:
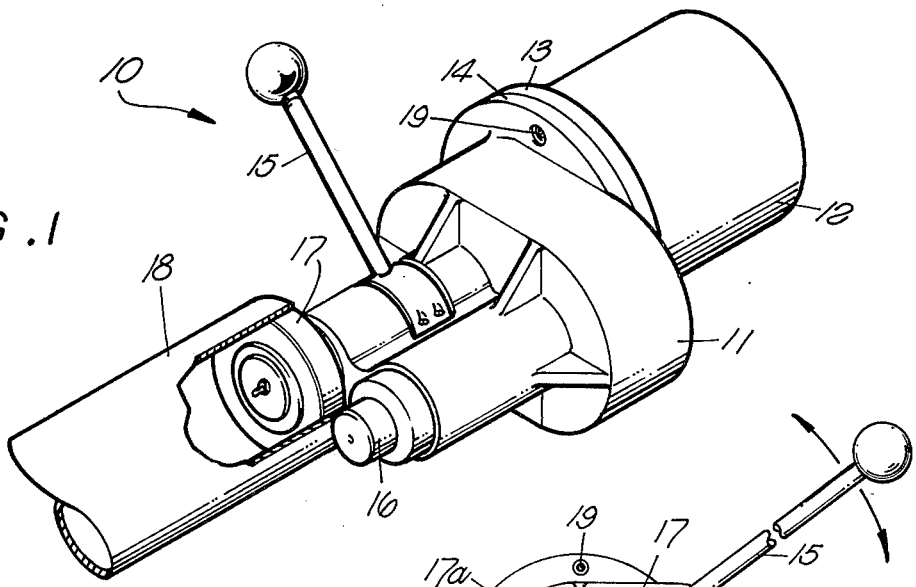
FIG. 1 is a pictorial of the machine according to the invention, in assembled form with tubuler work also shown.
Figure 2:
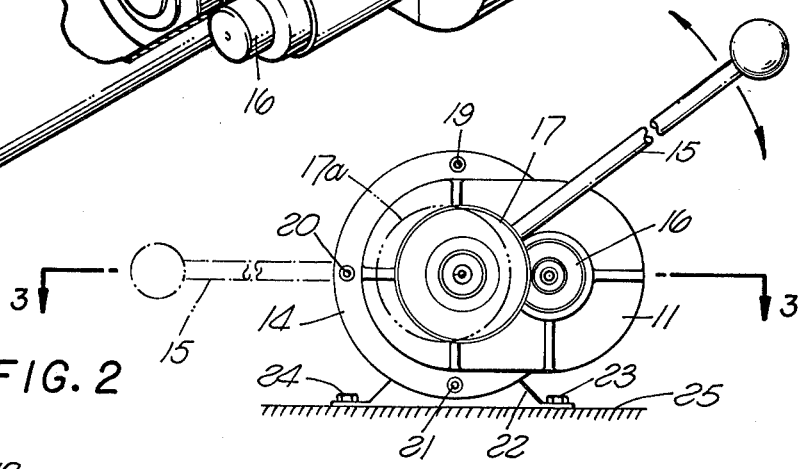
FIG. 2 is a roll end view of FIG. 1 to illustrate lateral advancement and withdrawal of the laterally controllable roll.

Referring to FIG. 2, the machine according to the invention is generally depicted. A commonly available NEMA C-face motor 12 having a mounting flange 13 is mounted to a corresponding flange 14 on the support housing 11 by means of a bolt ring, typically 19 (and 20 and 21 shown in FIG. 2). The support housing 11 is preferably a machined casting, this being a well-known manufacturing technique for machines of the general type.

The roll 16 is driven, in accordance with a mechanism described in connection with FIG. 3, but is laterally fixed. Roll 17 idles (rotationally), but is laterally positionable through an eccentric arrangement controlled by lever 15 to produce a pinching action against a portion of the wall of the tubular work 18. Depending upon the size of the tubing 18, it may be inserted over roll 16 as well as 17, and both rolls are obviously selectable and changeable as to size. Rolls 16 and 17 are illustrated as flat surface rolls and as such are adapted for deburring of tubular work. It is to be understood that these rolls can be nesting types; i.e., with complementary circumferential beads and grooves to effect circumferential beading or grooving of the work, or crimping of tubular fittings onto the work. Those processes are known per se, but the unique machine of the invention is to be understood to have utility in those various processes.

Referring now to FIG. 2, three of the four typical motor flange mounting bolts 19, 20 and 21 are visible and a mounting base 22, which is integral with support housing 11 or with motor 12 is shown bolted to a bench or other structure 25, by bolts 23 and 24.

The solid line position of lever 15 in FIG. 2 typically corresponds to closure of roll 17 agains roll 16, and the dashed line position of lever 15 corresponds to the roll "open" position 17*a*.

Figure 3:
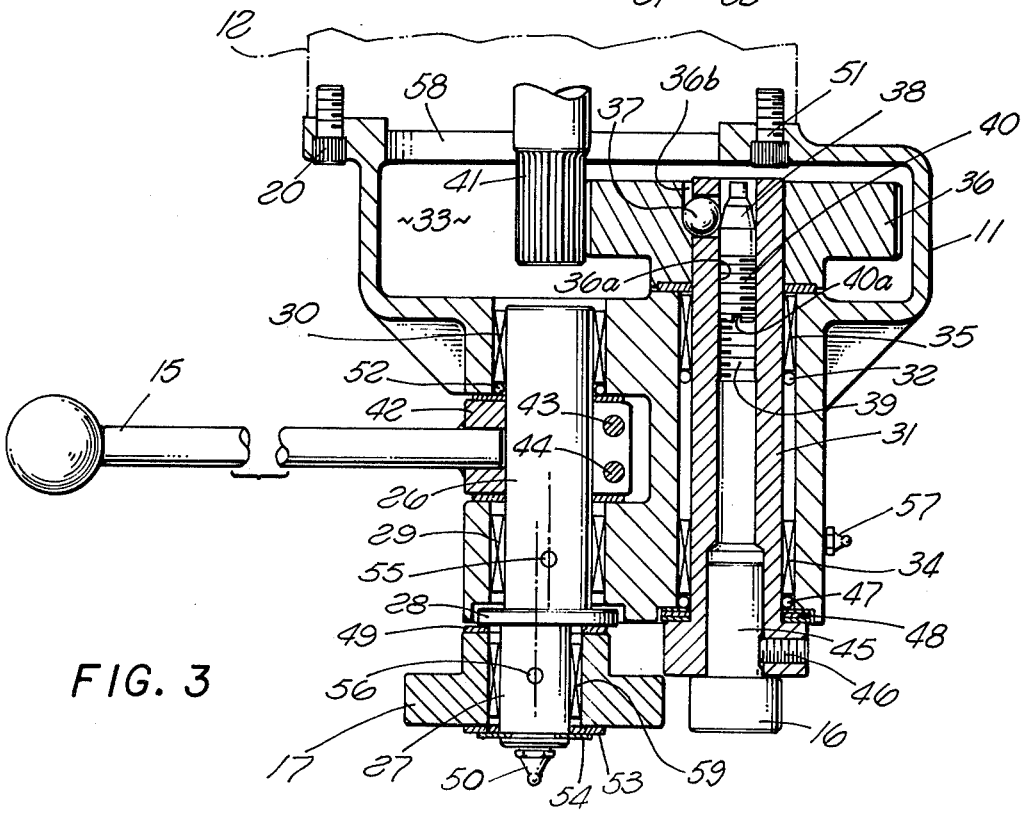
FIG. 3 is a sectional view taken in accordance with the sectioning line on FIG. 2, to show internal construction.

Referring now to FIG. 3, the sectioned view shows the details of the unique combination of the invention. It will be seen that the support housing 11 includes integral internal webs and solid cast sections into which bores are made axially to support and mount the shafts 26 and 31. Needle bearings 29 and 30 provide rigidity and excellent resistance to radial stresses experienced due to the pressure of the rolls against each other. Shaft 26 turns only in response to the positioning of lever 15 and does not otherwise rotate during operation. Shaft 31, on the other hand, rotates in response to the motor drive, pinion gear 41 on the motor shaft engaging gear 36 which is fixed to shaft 31, roll 16 being fixed to 31. Accordingly, roll 16 is the driver roll. Needle bearings 34 and 35 support shaft 31 against lateral stress (reaction) due to lateral roll pressure as was explained for shaft 26 and its needle bearings 29 and 30. Roll 27 is preferably also mounted on a needle bearing shown at 59.

Shaft 26 is gripped by a split collar 42, the tines of which are compressed together by bolts 43 and 44 in a well understood conventional manner, lever 15 being affixed to 42 as indicated.

In combination with a stop associated with lever 15, it is possible to very precisely set the open tangential gap between rolls by presetting the rotational position of clamp 42 on shaft 26 as 43 and 44 are tightened. Too large a gap may result in incomplete burr removal and too small a gap may cause "thinning of the tube wall and flaring".

Shaft 27 is rigidly fixed to shaft 26 by a plate section 28, the shaft 27 being offset as shown (with respect to 26) to form an eccentric. Actually, 26, 28 and 27 are preferably integral; i.e., are a single machined part, although they could obviously be fabricated separately and welded or furnace-brazed together to form the eccentric combination. Considerable strength is required of the eccentric, since it must resist lateral roll reaction forces as the needle bearings are required to do.

It will be evident at this point that lever 15 actuates the eccentric (which may be thought of as 28 and shaft portion 27), to determine the roll separation and closure. In FIG. 3, the rolls are depicted in their "open" relationship.

Control lever 15, in the dashed line position shown in FIG. 2 is resting on the stop provided by the lower edge of the support housing slot in which the collar 42 is emplaced. In the other position of 15 shown in FIG. 2, the support housing itself about shaft 31 provides a stop. Obviously other stops can be employed, such as structures which may be mounted on the support housing or the bench 25. Frequently it is very desirable to set the roller tangential open clearance with a feeler or thickness gauge. This can be done by adjustment of the collar 42 before 43 and 44 are tightened as the desired roller open clearance is held and with the lever 15 at its open stop (dashed line position of 15 on FIG. 2, for example).

Removal of the ball on lever 15 can readily provide a connection for an air cylinder or other hydraulic or purely mechanical means to operate lever 15, as for example by a foot pedal.

Since roll 17 rotates about shaft portion (eccentric shaft) 27, it may be held onto 27 by a washer 57 and C-ring 54, for example, providing axial constraint without the need to resist a significant thrust force at that joint. Another washer 49 rests between the roll 17 inward portion and eccentric plate 28. Lubrication provided through a grease zerk 50 is applied through shaft passages in a conventional manner to lubricate the roll 17 inside diameter interface with shaft 27. Similarly, the lubricant passes through opening 55 to lubricate bearing 29.

The cavity 33 would conventionally contain lubricating oil which lubricates bearings 30 and 35 and gears 41 and 36. Another grease zerk 57 provides for lubrication of bearing 34. Seals 52 and 32 provide containment of the oil in cavity 33 at the outward (toward the rolls) ends of bearings 30 and 35.

The structure and assembly of the drive components for roll 16 is of particular interest. Before motor 12 is affixed in place by bolting its flange 13 to support housing flange 14, an opening 58 is extant in the support housing. This opening 58 is large enough in diameter to admit gear 36 which is then pushed laterally to its approximate final position as seen in FIG. 3. The motor is then mounted as forementioned and the lateral play available is used to displace gear 36 still farther (to the right viewing FIG. 3) to permit the insertion of a tool for inerting and tightening bolt 51 through the shaft 31 bore and the gear center hole 36*a*. At this point in the assembly, shaft 31 and roll 16 are not yet in place. Motor flange bolts 19, 20 and 21 are obviously installed from the outside, only 51 requiring internal assembly.

Once the motor is fully mounted, pinion gear 41 is in place as illustrated and hollow shaft 31 with lock shaft 38 and locking ball 37 may be inserted from the roll end of the housing. Locking shaft is initially in a withdrawn position such that ball 37 does not protrude radially beyond the hollow shaft 31 outside diameter. As shaft 31 is inserted, it is pushed through gear bore 36*a* and rotated until ball 37 can move radially outward into a gear keyway or recess 36*b*. Advancement of locking shaft 40 by turning it with a screwdriver in slot 40a follows in view of the threaded engagement of 40 to the inside of hollow shaft 31. That step is accomplished by inserting a screwdriver through the axial hollow of 31, the roll 16 being not yet in place.

In accordance with the foregoing, gears 41 and 36 become engaged and ball 37 is pushed radially outward by the conical shape 38 of locking shaft 40 into the keyway 36b of gear 36 to lock 36 to shaft 31.

As a final assembly step, seal 47 and washer 48 are placed and roll 16 is inserted with its stem 45 into a counterbore in shaft 31 and is locked in place by set screw 46.

It will be noted that additional housing complexity at the motor end is avoided as compared to the need for access to gear 36 for assembly by more conventional arrangements.

The rolls 16 and 17 are preferably of a grade of tool steel having hardness and toughness appropriate therefor as determined from ordinary skill of the art. Similarly, the housing, shaft and other parts of the combination are fabricated of materials readily selected by the skilled mechanical engineer.

Modifications and variations will suggest themselves to those of skill in this art, and accordingly, it is not intended that the scope of the invention should be considered limited by the drawing and this description, these being intended as typical and illustrative only.

I claim:

1. A machine for performing deburring, pinch rolling and like operations, particularly on tubular stock, comprising:

first means including a first elongated shaft supported with rotational freedom at least by bearings adjacent its two ends, said first means further including a first roller affixed to an end of said first shaft and drive means for rotating said first shaft and first roller;

second means including a second elongated shaft supported with rotational freedom at least by bearings adjacent its two ends, said second means further including third means for rotating said second shaft over a predetermined angle under control of an operator;

support and housing means for mounting said first and second shaft members in generally parallel relationship;

and fourth means including a third shaft rigidly affixed to the end of said second shaft adjacent said first roller and a second roller rotationally mounted on said third shaft, the axes of said second and third shafts being offset such that rotation of said shaft causes the clearance between the perimeters of said first and second rollers to be varied as said second shaft is rotated in response to operation of said third means.

2. Apparatus according to claim 1 in which said drive means includes a source of mechanical rotation having a drive shaft and a pinion gear affixed thereon and a first gear meshed with said pinion gear and affixed to said first shaft at the end of said first shaft opposite said first roller.

3. Apparatus according to claim 2 in which said support and housing means includes an enclosure enclosing at least said pinion and first gears and said source of mechanical rotation is a C-face electric motor having an end plate beyond which said pinion gear projects, said enclosure having a matching opening covered by said motor end plate.

4. Apparatus according to claim 3 in which said support and housing means includes internal structural members having first and second axial bores therein coaxial with said first and second shafts, respectively, and in which said bearings are needle bearings inserted for providing rotational freedom for said first and second shafts with relatively large resistance to lateral roll reaction forces.

5. A machine for performing deburring, pinch rolling and like operations on tubular stock, comprising:

first and second rollers and first and second shaft members, said first and second roll being affixed in lateral juxtaposition on first ends of said first and second shaft members, respectively;

support and housing means for mounting said shaft members in generally parallel relationship and with rotational freedom;

first means comprising a source of mechanical rotation including a rotational drive shaft generally parallel to said first and second shafts, and a pinion gear mounted on said drive shaft;

a first gear mounted on the second end of said first shaft and means mounting said drive means so as to hold said pinion gear engaged to said first gear, thereby to provide continuous drive for said first roller;

second means comprising an eccentric mounted on said second end of said second shaft, said second roll being freely rotationally mounted on said eccentric such that changes of rotational position of said second shaft effect tengential clearance control between said rolls;

and third means comprising a control lever connected to a collar clamped to said second shaft, said collar having clamping means which may be adjusted to vary the tangential roll clearance as a function of the position of said control lever.

* * * * *